US005297520A

United States Patent [19]

Danyluk

[11] Patent Number: 5,297,520

[45] Date of Patent: Mar. 29, 1994

[54] FUEL SUPPLY SYSTEM WITH HIGH TURN DOWN RATIO

[75] Inventor: Paul R. Danyluk, Beloit, Wis.

[73] Assignee: Coltec Industries, Inc., New York, N.Y.

[21] Appl. No.: 977,937

[22] Filed: Nov. 18, 1992

[51] Int. Cl.[5] ..... F02B 3/00

[52] U.S. Cl. ..... 123/299; 123/525

[58] Field of Search ..... 123/299, 300, 525, 526, 123/575

[56] References Cited

U.S. PATENT DOCUMENTS 4,834,055 5/1989 Steiger ..... 123/300

*Primary Examiner*—Noah P. Kamen

*Attorney, Agent, or Firm*—Howard S. Reiter

[57] ABSTRACT

A fuel injection system for an internal combustion engine, such as a dual fuel diesel/gas engine of the type requiring an overall system turn-down ratio capability, from maximum fuel flow rate to minimum flow rate, on the order of 100 to 1, employs a conventional variable displacement primary pump having a turn-down ratio substantially less than the overall system ratio. The output of the primary pump branches to supply two parallel fuel conduit paths. Each path includes a pressure actuated shut-off valve means. The primary shut off valve means path opens to permit flow through the path to the engine at pressures in excess of a relatively high value. The secondary valve means opens to permit flow through the secondary path in response to a relatively lower pressure at the pump outlet. And, a fixed quantity fluid dispenser in the secondary flow path operates in response to opening of the secondary valve means, to displace a fixed quantity of fuel through the secondary path and into the engine.

9 Claims, 4 Drawing Sheets

FUEL SUPPLY SYSTEM WITH HIGH TURN DOWN RATIO

BACKGROUND OF THE INVENTION

This invention relates generally to fuel supply systems for internal combustion engines of the type that are capable of operating on either liquid fuel oil or natural gas. More specifically, it relates to a fuel injection system that is capable of selectively delivering precisely controlled quantities of fuel, varying between a minimum and a maximum that may be one hundred (100) times greater than the minimum, or more. The relationship between the maximum and minimum quantities of fuel within the range of such a fuel system is generally identified as the "turn-down ratio".

Combustion engines capable of operating, selectively, using either liquid fuel oil or natural gas, are generally well known. It is also known that when such engines are operated using natural gas as the primary fuel, it is necessary to supply the engine with minimum quantities of liquid fuel oil in addition to the natural gas. The fuel oil injected into the engine under these circumstances is generally identified as "pilot fuel". In this context, compression and consequent combustion of the pilot fuel acts as an ignition mechanism for the natural gas, to sustain operation of the engine without an electrically powered ignition system; this is the primary function of pilot fuel injection.

Engines of this type commonly produce undesirable by-products of fuel oil combustion in the form of oxides of nitrogen. The various oxides that are produced, including Nitrous Oxide and Nitric Oxide, have come to be identified by the all-inclusive coined symbol, NOx.

It has been generally known, for ten years or more, that an effective way to reduce the quantities of NOx produced by a dual-fuel engine when it is operating in the natural gas mode, is to reduce the quantities of pilot fuel supplied to the engine. The quantities of pilot fuel used by a dual-fuel engine may be expressed conveniently as a percentage of the fuel oil consumed by the engine when it is operating in the full diesel mode, at one hundred percent (100%) of its rated load. In the past, pilot quantities commonly averaged about five percent (5%) of full diesel mode fuel consumption. It has been determined that dual-fuel engines can be operated successfully using pilot fuel quantities that are as low as one percent (1%), or less, of the full diesel/full load fuel consumption, provided that the reduced fuel quantities are delivered to the engine consistently, accurately and reliably. Prior art fuel injection systems for these applications generally were not capable of meeting these requirements for supply of fuel quantities that were less than about five percent (5%) of full load consumption.

Although the relationship between reduction in pilot fuel quantities and corresponding reductions in NOx output has been known for many years, interest in exploitation of this knowledge has been limited. In general, the limitations have been a result of restrictions imposed by the economics and existing technology of available fuel oil supply systems for dual-fuel engines. Specifically, the pumps or pumping devices used in diesel fuel systems are dominated by positive/variable-displacement piston pumps of the type known as a "jerk-pump", which is characterized by a rack-adjustment mechanism. The "rack" mechanism varies the quantity of fuel delivered by the pump, by varying the length of the portion of each piston stroke during which pumping takes place. Despite many years of existence, evolution and improvements in design, rack adjustment pumps generally are not capable of delivering, reliably, minimum fuel quantities that are less than approximately five percent (5%) of the rated maximum of the pump. For this reason, dual-fuel engines in the past customarily have been operated using no less than approximately "five percent (5%) pilot fuel".

As mentioned previously, the relationship between the maximum quantity and the minimum fuel quantity that can be delivered reliably by a given pump is referred to as the turn-down ratio. It can be recognized, accordingly, that a conventional pump that is capable of delivering, reliably, minimum quantities that are not substantially less than five percent (5%) of the maximum quantity, has a turn-down ratio of twenty to one (20:1). By significant contrast, a pump, or fuel-supply system, capable of delivering precisely controlled minimum quantities of pilot fuel that represent one percent (1%) (or less) of the maximum capacity of the pump, can be seen to represent a turn-down ratio of one hundred to one (100:1). It is highly significant that the turn-down ratio of such a system is five times greater than the turn-down ratio capability of pumps and injection systems that are considered to be the best available in the prior art.

The alternative of providing a dual-fuel engine with two independent fuel injection systems, one for injecting pilot fuel quantities, and another for injecting full-diesel fuel quantities, has been considered in the past. However, this approach generally has been rejected on the basis of the excessive costs of original equipment as well as the substantial increase in prospective maintenance.

Accordingly, it is an object of this invention to provide a fuel supply system, for dual-fuel engines, that is capable of delivering reliably, pilot fuel quantities that are equal to one percent (1%) or less of the maximum fuel pumping capacity of the pump, using a common supply pump.

Another object of the present invention is to provide a unified fuel injection system for use with dual-fuel engines, that is capable of delivering pilot fuel quantities, reliably, that represent a turndown ratio on the order of one hundred to one (100:1).

These and other and further objects, features and advantages of this invention will be made apparent to those having skill in this art by the following specification and claims considered with reference to the accompanying drawings, in which:

DETAILED DESCRIPTION

Figure 1:
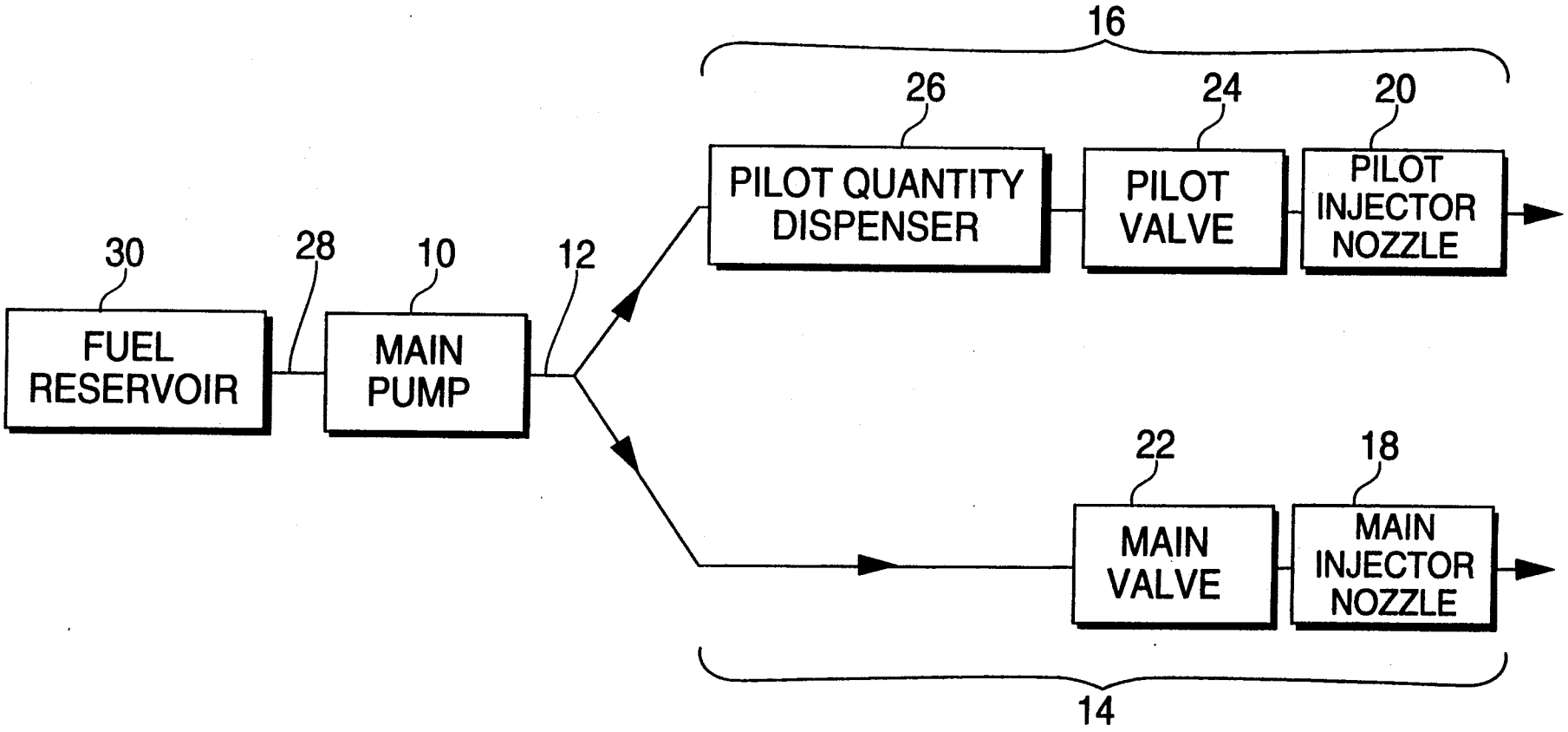
FIG. 1 is a schematic diagram of a fuel supply system in accordance with this invention.

Referring now more specifically to the drawings, a fuel system in accordance with this invention may be seen to comprise a main fuel pump 10 having an outlet 12 coupled to deliver fuel to two parallel injector paths 14 and 16. Path 14 is a main fuel path that serves to deliver fuel to an engine (not shown) through a main injector 18, while path 16 is a pilot fuel path that delivers pilot fuel quantities to the same engine through a pilot injector 20. In each fuel path, a pressure actuated valve 22, 24 is serially connected between the respective injectors 18, 20 and the outlet 12 of main pump 10. Pilot fuel path 16 additionally includes a hydraulically actuated fixed quantity fuel dispenser 26 serially connected with valve 24 in the fuel flow path between pump outlet 12 and pilot injector 20. Main pump 10 further includes an inlet 28 for receiving fluid fuel from a supply source which may be a tank 30 or any other suitable fluid reservoir of conventional design and function.

The main pump 10 may be a conventional positive/-variable-displacement rack-type piston pump of known design, with a turn-down ratio capability of approximately 20:1 (e.g., a jerk-pump), capable of delivering selectively variable quantities of fluid fuel through outlet 12. The selected quantities may vary between the maximum for which the pump is rated, and the minimum which can be delivered by the pump, effectively. The pressurized final output of such pump is characterized by a repeated series of "pulses" each representing a selected quantity of fuel delivered through the outlet of the pump within a known time interval. The "pulses" are separated from each other by separate time intervals all of which are related to the design characteristics and speed of operation of the pump. Such pumps are generally well known in the art; a representative form of such a pump is illustrated and described clearly in various reference books such as *Internal Combustion Engines Analysis and Practice*, by Edward F. Obert, published by International Text Book Company of Scranton, Pa., which is incorporated herein. This invention contemplates the use of such a pump in a conventional manner without alteration or modification other than ordinary accommodation to the parameters of a specific application such as pressure, quantities, timing, dimensions and the like. The modifications required for a specific application will be readily determined by those having ordinary skill in this art.

For the purposes of this invention, the capability of selecting the total quantity of fuel that is displaced during each cycle of the pump, is significant. It is known that the fluid pressure produced by forcing fluid into a generally closed space, increases proportionally as the volume of fluid is increased. The "rack" settings of the type of pump described herein, are directly related to the volume of fluid displaced; accordingly, the volume of fluid displaced through pump outlet 12, and the fluid pressure developed in parallel paths 14, 16 increases selectively, as the "rack" settings of pump 10 are increased.

Each one of serially connected pressure actuated valve means 22, 24 is of the type which opens when fluid pressure applied to the inlet exceeds a given value. The fixed quantity dispenser 26 in path 16 is a serially connected, hydraulically-actuated positive/fixed displacement plunger mechanism which operates in response to the opening of pilot valve 24 to displace a fixed quantity of fluid along path 16, through pilot injector 20, once only, each time valve 24 opens. In this regard, pilot fuel path 16 adds a fixed, low quantity delivery capability to the high-quantity variable capability of path 14. Dispenser 26 is shown in more detail in FIG. 2 and FIG. 3, and its operation will be further described, below.

Figure 4:
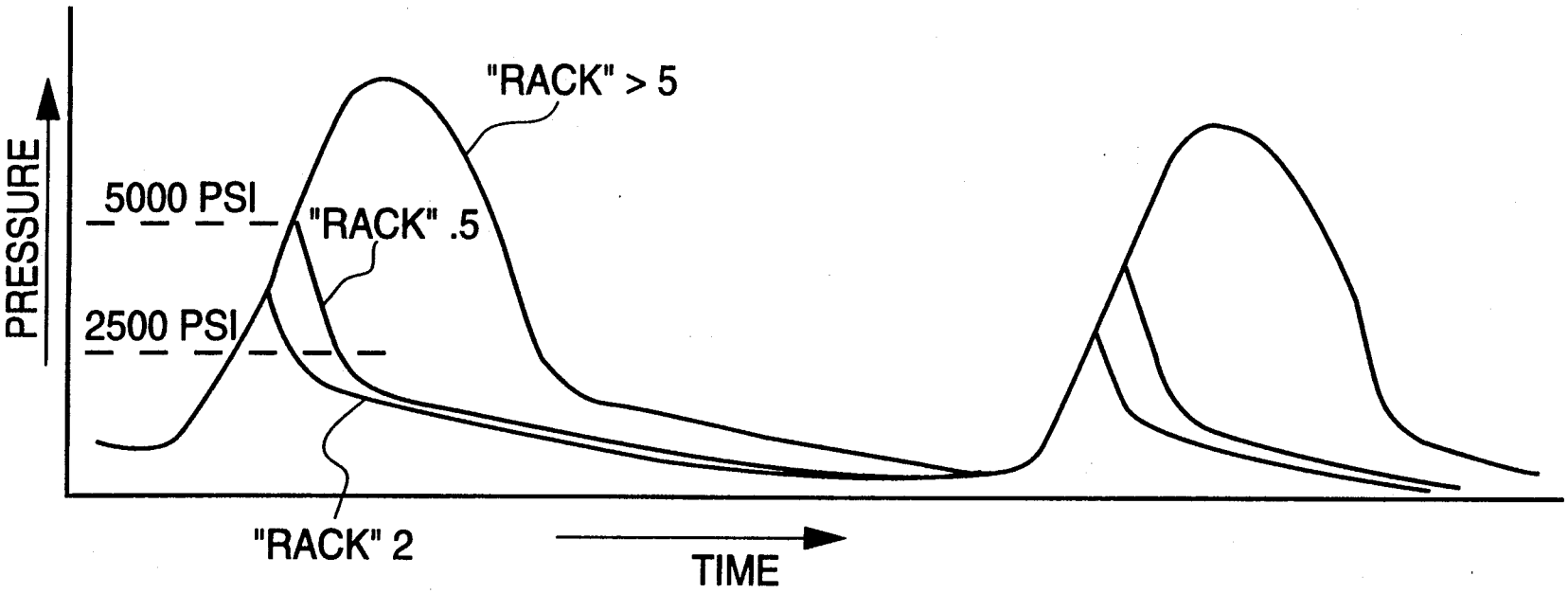
FIG. 4 is a chart showing fuel pressure variations and related significant events as a function of time within the system of FIG. 1.

The operation of the system of FIG. 1 is further illustrated and explained by the chart of FIG. 4 which shows in graphic form, how fluid pressure at the pump outlet 12 of FIG. 1 varies regularly from low values to higher values depending upon the "rack" settings of main pump 10. For purposes of illustration only, main valve 22 has been assigned a predetermined opening value of 5,000 psi and pilot valve 24 has been assigned a predetermined opening value of 2,500 psi.

With further reference to FIG. 4, it can be seen that at the relatively low "rack" setting 2 of primary pump 10, the pressure at the inlet to fixed quantity dispenser 26, which corresponds to the pressure at pump outlet 12, builds as pump 10 operates until pilot valve 24 opens at the first predetermined pressure 2,500 psi, and then drops sharply as fluid flows through the valve and through nozzle 20. The remainder of the fuel displaced by pump 10 is drained from paths 14, 16, through the bleed line path 32 (see FIG. 2) in dispenser 26 in a manner that will be described further, below. As the "rack" setting of the main pump is increased, pressure at outlet 12 continues to build, but main valve 22 remains closed until the main path predetermined pressure of 5,000 psi is exceeded just above rack 5. It should be noted however, that the fixed quantity delivered to the engine through nozzle 20 never varies, regardless of the "rack" setting.

While main valve 22 remains closed, the total quantity of fuel delivered to an engine through injectors 18, 20 is limited to the fixed quantity displaced through injector 20 by dispenser 26 for each opening of pilot valve 24. Excess fuel delivered to dispenser 26 by pump 10 is carried away and returned to reservoir 30, in a manner to be described below, while fluid pressure at pump outlet 12 remains below the predetermined main value (5,000 psi).

When the rack setting of primary pump 10 is increased to a point (symbolized as "rack" $>5$) at which a greater quantity of fuel is delivered to outlet 12 than can be passed readily through the total capacity of pilot path 16, the pressure at outlet 12 will continue to increase until it exceeds the predetermined main pressure value (5,000 psi), and main valve 22 will open. The opening of main valve 22 will deliver an additional quantity of fuel to an engine through injector 18. The quantity delivered through valve 22 is determined by the capacity and settings of pump 10, and the overall fluid flow characteristics of each component of fuel paths 14, 16. At substantially higher rack settings, pressure will continue to rise, even after the opening of main valve 22 because the pump continues to deliver fuel in excess of the amount that can be discharged immediately through the two flow paths 14, 16. The quantity delivered to the engine through main path 14 will be over and above the fixed amount that will continue to be delivered through pilot path 16.

Although the system of FIG. 1 contemplates delivery of fuel to an engine through two independent injectors 18, 20, it should be understood that paths 14, 16 may be combined again, between valves 22, 24 and the engine, into a single, combined conduit for delivery into an engine cylinder through a single injector device, if desired.

Figure 2:
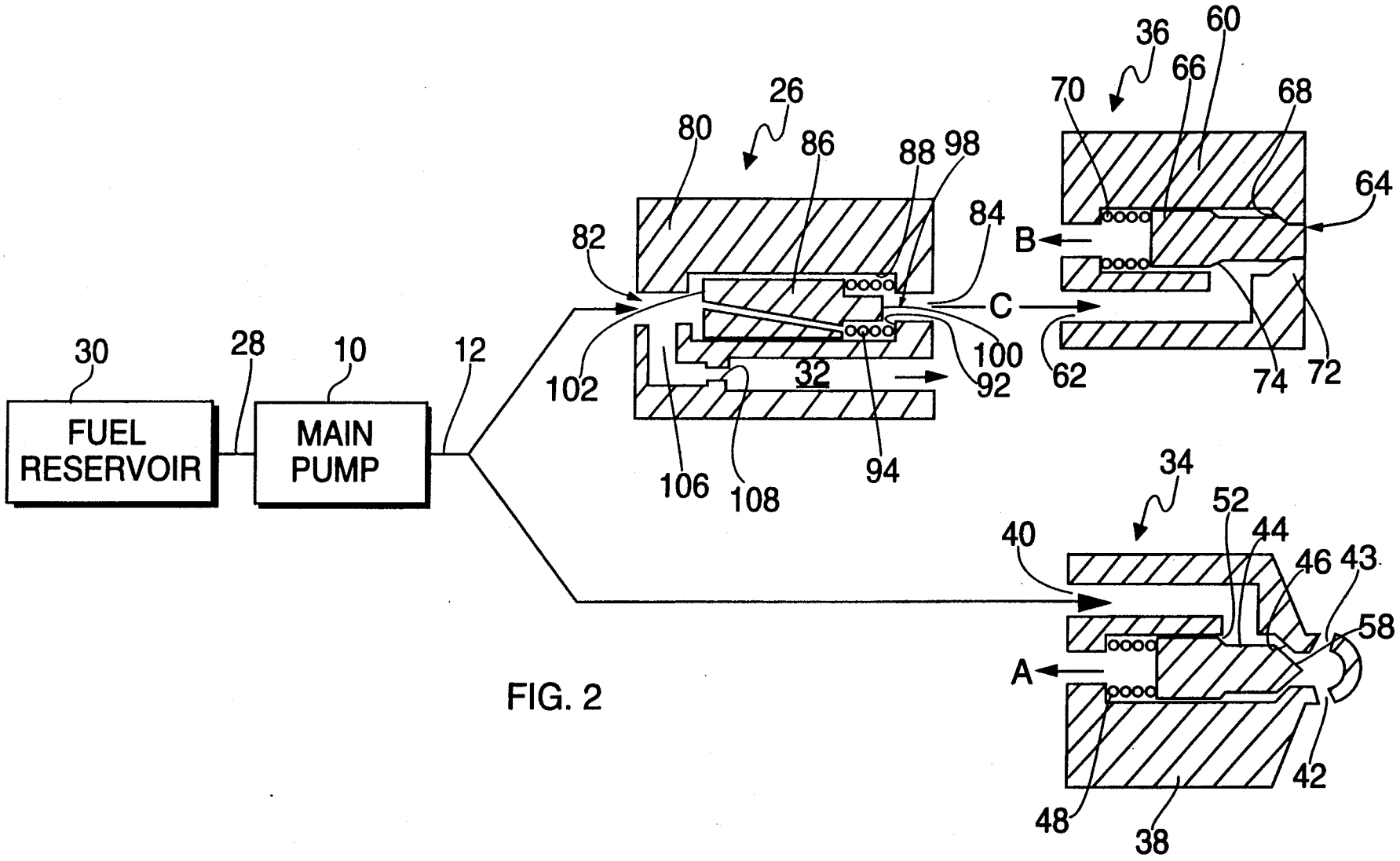
FIG. 2 is a partial schematic diagram of the fuel supply system of FIG. 1, showing certain elements in cross-sectional detail.
Figure 3:
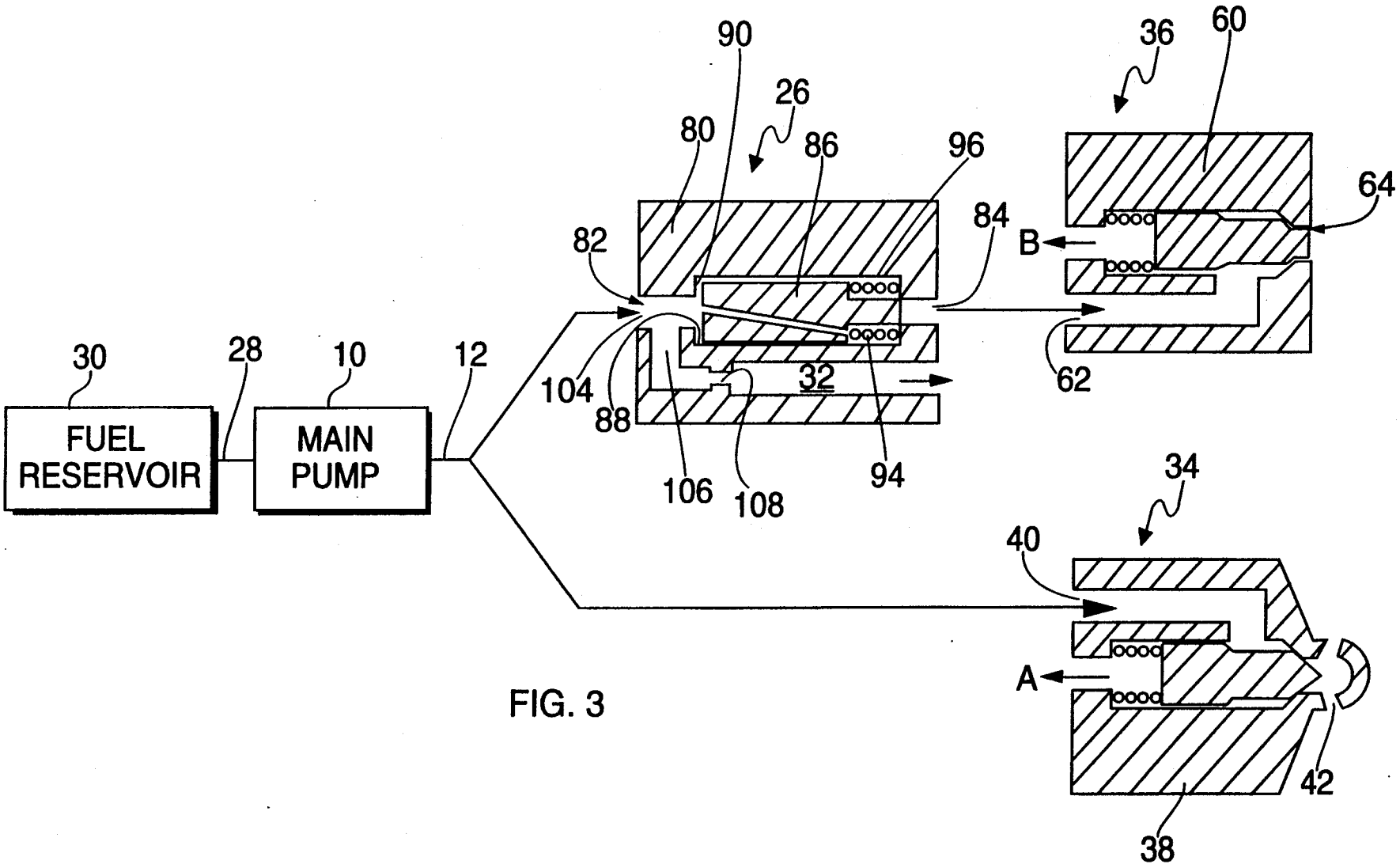
FIG. 3 is a view of the fuel supply system of FIG. 2, showing the condition of the system when fluid pressure has been increased to a desired level.

In this embodiment of invention, FIGS. 2 and 3 illustrate engine fuel injector nozzle assemblies 34, 36 which directly incorporate both nozzle openings and pressure actuated valve means into a single combined assembly in which the valve portion operates directly to control flow of fuel into an engine through one or more injector openings.

Accordingly, main injector assembly 34 as shown in FIGS. 2 and 3 may be seen to comprise a housing 38 having a main assembly inlet path 40 leading through the housing to injector openings 42. The flow of fuel through housing 38 is obstructed by a valve means comprising valve plunger 44, valve seat 46 and biasing spring 48, which together correspond to main valve 22 shown in FIG. 1. In a well known manner, valve spring 48 urges plunger 44 into engagement with valve seat 46 on housing 38 so that the mating valve face 50 on the plunger engages the valve seat 46 and seals the internal space defined by inlet path 40 to prevent fluid flow through openings 42.

The fluid pressure applied to inlet path 40 fills the internal space within housing 38 resulting in a net hydraulic force acting on pressure-receiving surface 52 of plunger 44, urging the plunger toward the left in the direction of arrow A, against the counteracting force of helical compression spring 48. When the total hydraulic force, represented by the result of multiplying the area of pressure surface 52 by the applied fluid pressure in path 40, exceeds the force produced by spring 48, plunger 44 will move in the direction of arrow A, and valve face 50 will move away from valve seat 46 to permit fluid flow from inlet path 40 through injector openings 42. The space behind spring 48, on the side remote from plunger 44, is vented to atmospheric or ambient pressure, generally, to facilitate opening and closing of the valve in response to fluid pressure changes in path 40.

Similarly, pilot injector assembly 36 may be seen to comprise a housing 60, having an inlet path 62 leading through the housing to injector opening 64. The flow of fuel through the housing via path 62 is controlled by a valve means including plunger 66, valve seat 68, and biasing spring 70. In essentially the same manner as in assembly 34, the plunger 66 includes a valve face 72 that engages seat 68 on housing 60, under force exerted by biasing spring 70 in a well known manner. When valve face 72 is seated against valve seat 68, the flow of fluid through pilot injector opening 64 is obstructed. When fluid pressure within path 62 in housing 60 exerts sufficient force acting on pressure surface 74 to overcome the force exerted by spring 70, plunger 66 will move to the left, in the direction of arrow B, and valve face 72 will be disengaged from valve seat 68 as shown in FIG. 3. Separation of valve face 72 from valve seat 68 allows fuel to flow through injector opening 64 into an engine.

Although injector assembly 34 and injector assembly 36 are shown in two different configurations, it should be understood that this is regarded primarily as a matter of choice; based upon considerations such as cost, parts availability and engine design requirements relating to parameters such as fuel quantities, timing, desired spray patterns and combustion characteristics.

The fixed quantity one-shot dispenser assembly 26 shown in cross-sectional detail in FIGS. 2 and 3 represents an important feature of this invention. It operates in response to cyclical variations in fluid pressure at outlet 12 of pump 10, to deliver a precisely controlled and predetermined quantity of fuel to the inlet path 62 of injector assembly 36 each time the valve controlled by pilot plunger 66 is opened. Dispenser 26 may be seen to comprise a housing 80 having an inlet port 82, an outlet port 84 and a drain path 32. The inlet port 82 is coupled to receive fluid directly from the outlet 12 of pump 10 while the path 32 is coupled directly to the inlet 82 within the housing.

Within housing 80 a shuttle (plunger) element 86 is mounted in a cylinder chamber 88 for reciprocating movement between a rearward shoulder 90 and a forward shoulder 92. A biasing spring 94 acts against an intermediate shoulder 96 on shuttle 86 to urge the shuttle toward rear shoulder 90 and away from forward shoulder 92. When shuttle 86 is seated against rearward shoulder 90 under the force of spring 94, a dispensing volume 98 is defined within cylinder 88, by forward shoulder 92 and the forward end 100 of shuttle 86.

Within shuttle 86, a filler passage 102 extends from its rear face 104 to its forward end 100 at dispensing volume 98. Fuel entering housing 80 through inlet 82 passes through filler passage 102 to fill dispensing volume 98 as well as the fluid conduits (not shown) coupling dispenser 26 to assembly 36 along with the fluid containing spaces within housing 60.

Drain path 32 in housing 80 of dispenser 26 is coupled directly to return fuel to first reservoir 30 or any suitable storage means in any well known manner, via conventional fluid conduits, not shown. Within housing 80, drain path 32 is open to inlet port 82 at drain inlet opening 106, so that excess fuel delivered to inlet port 82 can be drained away to prevent undesired pressure build up. Within drain path 32, a restriction 108 limits the time rate of fluid flow through the path. The size of restriction 108 is selected so that when fluid is delivered to inlet port 82 by pump 10 at a rate greater than the rate at which fluid can escape through path 14 and drain path 32, the fluid pressure on end face 104 of shuttle 86 will increase until the counteracting force of biasing spring 94 is overcome, and shuttle 86 is moved to the right in the direction of arrow C. In this regard, the dimensions of filler passage 102 are selected to provide a time rate of fluid flow such that the fluid pressure at end face 104 will exceed the fluid pressure at the other end of passage 102, on forward face 100, long enough to displace the shuttle 86 against the force of biasing spring 94. Movement of shuttle 86 in this manner displaces a precisely controlled quantity of fuel from dispensing volume 98 into the inlet path 62 of injector assembly 36, through coupling conduits (not shown) of any suitable type. If desired, a restriction may be incorporated into filler path 102 in the manner of restriction 108 in drain path 32, to control the rate of flow in the filler path.

Although a particular embodiment of this invention has been disclosed and described, it should be recognized that other and equivalent embodiments and variations may be created within the scope of this invention as defined in the following claims.

I claim:

1. A fuel supply system for an internal combustion engine of the type requiring a high turn-down ratio for full range operation, said system comprising:

a fuel pump operable to deliver sequentially repeated pulses of fuel wherein the quantity of fuel delivered in each pulse is selectable within a range between a maximum and an effective minimum;

said fuel pump having an inlet connnectable to a fuel reservoir, and an outlet through which said repeated pulses of fuel are delivered;

a first fuel path having an inlet connected to the said outlet of said fuel pump, and an outlet for delivering fuel to an engine;

a first pressure-actuated valve means in said first fuel path, operable in response to fluid pressure in said first fuel path in excess of a first predetermined value, to permit flow of fuel through the outlet of said first fuel path;

a second fuel path having an inlet connected to the said outlet of said fuel pump, and an outlet for delivering fuel to an engine;

a second pressure-actuated valve means in said second fuel path, operable in response to fluid pressure in said second fuel path in excess of a second predetermined value that is less than said first predetermined value, to permit flow of fuel through the outlet of said second fuel path;

a fixed quantity fuel dispenser connected in said second fuel path for delivering a predetermined quantity of fuel through said second fuel path once only in response to each opening of said pressure actuated valve means, wherein said predetermined quantity is less than the effective minimum quantity of fuel in any pulse delivered by said fuel pump.

2. A fuel supply system in accordance with claim 1, wherein: the said outlet of said first fuel path comprises a main injector nozzle; and said first pressure actuated valve means and said main injector nozzle are incorporated together in a unitary main injector assembly.

3. A fuel supply system in accordance with claim 2, wherein: said main injector nozzle incorporates multiple orifices through which fuel flows into an engine.

4. A fuel supply system in accordance with claim 1, wherein: the said outlet of said first fuel path comprises a pilot injector nozzle; and said first pressure actuated valve means and said pilot injector nozzle are incorporated together in a unitary pilot injector assembly.

5. A fuel supply system in accordance with claim 4, wherein: said pilot injector nozzle is a pintle nozzle.

6. A fuel supply system in accordance with claim 1, wherein: said fixed quantity fuel dispenser is serially connected in said second fuel path between the outlet of said pump and said second pressure actuated valve means.

7. A fuel supply system in accordance with claim 6, wherein said fixed quantity fuel dispenser comprises: a housing having a cylinder therein and an inlet giving access to one end of said cylinder and an outlet giving access to the other end of said cylinder, a shuttle piston positioned within said cylinder for reciprocating motion therein between a first position at the inlet end of the cylinder and a second position at the outlet end of the cylinder, a biasing spring within said housing positioned to bias said shuttle piston into said first position, and a fuel conduit for carrying fuel from the inlet end of said cylinder to the outlet end thereof; said shuttle being displaceable from said first position to said second position to displace a fixed quantity of fuel from the outlet end of said cylinder when a predetermined difference exists between the fuel pressure at the inlet end of said cylinder and the fuel pressure at the outlet end thereof.

8. A fuel supply system in accordance with claim 7, wherein said housing of said fixed quantity fuel dispenser further includes a drain passage extending from said inlet to said cylinder for carrying away from said inlet, at a predetermined rate, fuel in excess of the quantity required for operation of said shuttle.

9. A fuel supply system for an internal combustion engine of the type requiring a high turn-down ratio for full range operation, said system comprising:

a main pump, having a fuel inlet port and a fuel outlet port, operable to deliver fuel from said inlet port to said outlet port and to develop an outlet pressure that varies cyclically between a first value and a second, relatively higher value, in response to operation of said pump;

adjustable means on said main pump for selectively varying the quantity of fuel delivered from said inlet port to said outlet port during each cycle of operation of said pump, between a minimum value and a maximum value;

a fixed-quantity fluid fuel dispenser having an inlet passage, an outlet passage, and a drain passage; said fuel dispenser being responsive to cyclically varying hydraulic pressure at said inlet passage for delivering a predetermined quantity of fuel through said outlet passage once during each cyclic variation of pressure applied to said inlet passage, said predetermined quantity being independent of the total pressure and total quantity of fuel applied to said inlet passage;

means coupling the outlet port of said main pump to the input passage of said dispenser for operating said fuel dispenser in response to operation of said first pump;

a main fuel valve assembly having an inlet for receiving fuel and an outlet for delivering fuel to an internal combustion engine, said valve assembly being pressure-operated for preventing flow of fuel through said outlet when the pressure of the fuel received at said inlet is less than a second predetermined value, said second predetermined value being greater than said first predetermined value;

means coupling the output port of said main pump to the inlet of said main fuel valve assembly for application of pressurized fuel thereto; and overflow means associated with said fuel dispenser for receiving the quantity of fuel delivered to the inlet passage of said dispenser in excess of said predetermined quantity during each cycle of said main pump.

* * * * *